US008997921B2

(12) United States Patent
Uzawa et al.

(10) Patent No.: US 8,997,921 B2
(45) Date of Patent: Apr. 7, 2015

(54) EXHAUST SYSTEM OF SADDLE-RIDE TYPE VEHICLE

(71) Applicant: Honda Motor Co., Ltd., Tokyo (JP)

(72) Inventors: Yuki Uzawa, Wako (JP); Yoshitaka Hayama, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 14/036,809

(22) Filed: Sep. 25, 2013

(65) Prior Publication Data

US 2014/0090924 A1 Apr. 3, 2014

(30) Foreign Application Priority Data

Sep. 28, 2012 (JP) ..... 2012-217664

(51) Int. Cl.
*F01N 1/08* (2006.01)
*F01N 13/18* (2010.01)
*F01N 13/08* (2010.01)

(52) U.S. Cl.
CPC ..... *F01N 1/08* (2013.01); *F01N 13/082* (2013.01); *F01N 13/18* (2013.01); *F01N 13/1855* (2013.01); *F01N 1/084* (2013.01); *F01N 1/089* (2013.01); *F01N 2590/04* (2013.01)

(58) Field of Classification Search
CPC ... F01N 13/082; F01N 13/18; F01N 13/1855; F01N 1/08; F01N 1/089; F01N 1/084; F01N 2590/04
USPC ..... 181/227, 228, 243
See application file for complete search history.

(56) References Cited

U.S. PATENT DOCUMENTS

| | | | | |
|---|---|---|---|---|
| 1,995,542 | A * | 3/1935 | Haviland | 285/322 |
| 3,563,338 | A * | 2/1971 | Rader | 181/243 |
| 5,633,482 | A * | 5/1997 | Erion et al. | 181/282 |
| 7,470,301 | B2 * | 12/2008 | Heydens | 55/523 |
| 7,510,050 | B2 * | 3/2009 | Emler | 181/249 |
| 7,946,380 | B2 * | 5/2011 | Yamamoto et al. | 181/227 |
| 7,997,383 | B2 * | 8/2011 | Sakurai et al. | 181/252 |
| 8,002,081 | B2 * | 8/2011 | Honma et al. | 181/256 |
| 2006/0124384 | A1 * | 6/2006 | Tary et al. | 181/243 |
| 2009/0107760 | A1 * | 4/2009 | Sammut | 181/241 |
| 2009/0120716 | A1 * | 5/2009 | Yamamoto et al. | 181/205 |

FOREIGN PATENT DOCUMENTS

JP 2009-108824 A 5/2009

* cited by examiner

*Primary Examiner* — Jeremy Luks
(74) *Attorney, Agent, or Firm* — Birch, Stewart, Kolasch & Birch, LLP

(57) ABSTRACT

An exhaust system of a saddle-ride type vehicle includes an end cap and a muffler close to each other to achieve uniformity therebetween and which is capable of preventing the occurrence of a knocking sound. The exhaust system of a saddle-ride type vehicle includes a muffler connected to an exhaust pipe for discharging exhaust of an engine E and an end cap is attached to a muffler rear end portion. In the end cap, an insertion portion thereof is inserted into and held by an end cap inserted portion provided in the muffler rear end portion, and multiple protruding portions are formed on an outer surface of the insertion portion at a predetermined interval in a circumferential direction of the outer surface. The multiple protruding portions come in contact with an inserted portion inner peripheral wall surface of the end cap inserted portion.

22 Claims, 11 Drawing Sheets

EXHAUST SYSTEM OF SADDLE-RIDE TYPE VEHICLE

CROSS-REFERENCE TO RELATED APPLICATIONS

The present application claims priority under 35 USC 119 to Japanese Patent Application No. 2012-217664 filed Sep. 28, 2012 the entire contents of which are hereby incorporated by reference.

BACKGROUND OF THE INVENTION

1. Field of the Invention

The present invention relates to an exhaust system of a saddle-ride type vehicle. More particularly, to an exhaust system of a saddle-ride type vehicle including an end cap at a rear end of a muffler.

2. Description of Background Art

A conventional saddle-ride type vehicles, for example a motorcycle, is known wherein an end cap is attached to a rear end of a muffler provided behind an exhaust pipe for discharging combustion exhaust gas. See, for example, Japanese Patent Application Publication No. 2009-108824.

In the end cap and the muffler disclosed in Japanese Patent Application Publication No. 2009-108824, a small distance between the end cap and the muffler is not preferable because a knocking sound that occurs between the muffler and the end cap due to vibrations of the muffler during exhaustion. To prevent the knocking sound, a predetermined clearance between the end cap and a rear end of the muffler is provided.

In the exhaust pipe of the motorcycle, since the muffler is exposed, the appearance can be improved by providing the end cap. When the structure in which the clearance is provided between the muffler rear end and the end cap is employed to avoid the knocking sound as described above, uniformity between the end cap and the muffler is impaired and the appearance deteriorates.

SUMMARY AND OBJECTS OF THE INVENTION

The present invention has been made in view of the circumstances described above. An object of an embodiment of the present invention is to provide an exhaust system of a saddle-ride type vehicle that is improved in appearance by providing the end cap and the muffler close to each other to achieve uniformity between the end cap and the muffler and which is capable of preventing the occurrence of a knocking sound.

For the purpose of solving the above-mentioned problems, according to an embodiment of the present invention, an exhaust system of a saddle-ride type vehicle includes a tubular muffler connected to an exhaust pipe for discharging exhaust of an engine and includes an end cap attached to a muffler rear end portion of the muffler. In the exhaust system, an insertion portion at a front end side of the end cap is inserted into and held by an end cap inserted portion provided in the muffler rear end portion. A plurality of protruding portions protruding outward in a radial direction are formed on an outer surface of the insertion portion, at a predetermined interval in a circumferential direction of the outer surface. The protruding portions come into contact with an inserted portion inner peripheral wall surface of the end cap inserted portion.

According to an embodiment of the present invention, the protruding portions are provided at three positions at substantially equal intervals in the circumferential direction.

According to an embodiment of the present invention, the end cap is attached to a boss portion provided in the muffler rear end portion with a fastening member.

According to an embodiment of the present invention, the boss portion is provided at two positions symmetric to each other about a muffler center axis.

According to an embodiment of the present invention, a center axis of the end cap and a center axis of the muffler are arranged coaxial to each other with a center axis of a tail pipe for discharging the exhaust from the muffler being offset from the center axis of the muffler. A tail pipe hole of the end cap through which the tail pipe is inserted is offset from the center axis of the end cap with the center axis of the tail pipe being arranged to pass through a center point of the tail pipe hole.

According to an embodiment of the present invention, the end cap includes a tubular cap outer tube portion; an insertion portion extending forward from a front end of the cap outer tube portion; and a cap inner tube portion attached to an inner side of a rear end of the cap outer tube portion and disposed closer to a front of the vehicle than the rear end. A fixed portion, configured to be fastened to the boss portion, is provided in the cap inner tube portion. A tool insertion recessed portion for allowing insertion of a tool is formed around the fixed portion.

According to an embodiment of the present invention, the end cap inserted portion is formed in a folded portion in which a muffler body portion rear end of the muffler rear end portion is folded to an inner side.

According to an embodiment of the present invention, the insertion portion of the end cap is inserted and attached to the end cap inserted portion of the muffler rear end portion and the insertion portion of the end cap and the end cap inserted portion of the muffler rear end portion are thereby connected to each other while overlapping each other in the muffler radial direction. Accordingly, the end cap is connected to the muffler with an excellent uniform appearance. Moreover, since the protruding portions protruding outwardly in the muffler radial direction are formed at the predetermined interval in the circumferential direction of the outer surface of the insertion portion of the end cap, the protruding portions come into contact with the inserted portion inner peripheral wall surface of the muffler rear end portion. Accordingly, in the joint between the muffler rear end portion and the end cap, a state is maintained wherein the muffler rear end portion and the end cap come into firm contact in the radial direction and are fitted to each other. This prevents a knocking sound between the end cap and the muffler rear end portion due to muffler vibration during exhaustion.

According to an embodiment of the present invention, the protruding portions are formed at the three positions at substantially equal intervals in the circumferential direction. Accordingly, the alignment between the center axis of the end cap and the center axis of the muffler is facilitated and the assemblability is thereby improved.

According to an embodiment of the present invention, the boss portion for attaching the end cap is provided and the end cap is fastened to the boss portion with the fastening member for mounting the end cap. Accordingly, the end cap is firmly fixed to the muffler and the occurrence of a knocking sound between the end cap and the muffler rear end portion due to muffler vibration is thereby more effectively prevented.

According to an embodiment of the present invention, the boss portion for fixing the end cap is provided at the two positions symmetric to each other about the muffler center axis. Accordingly, the fixation can be achieved with no shifting of the fastening positions. Thus, the contact force of the end cap in the muffler radial direction which is provided by the protruding portions can act evenly, and the contact between the end cap and the muffler rear end portion is thus maintained in an excellent state. Moreover, the fixation is surely achieved by using a small number of fastening members.

According to an embodiment of the present invention, the tail pipe and the tail pipe hole are offset from the muffler center axis. Accordingly, the direction of the exhaust, the position of an exhaust outlet port, the length of the tail pipe can be arbitrarily set for improving the freedom in muffler performance adjustment. In addition, since the center axis of the end cap and the center axis of the muffler are aligned with each other, the muffler rear end portion and the end cap appears to be integrally connected to each other and the appearance is improved.

According to an embodiment of the present invention, in the end cap, the cap inner tube portion is disposed on the inner side of the cap outer tube portion and the fixed portion of the cap inner tube portion is fixed to the boss portion. Accordingly, an attachment structure of the end cap is invisible as viewed in a lateral direction of the vehicle and the appearance is improved. Moreover, since the tool insertion recessed portion allowing for the insertion of a tool is formed around the fixed portion of the cap inner tube portion, the operation using the tool is facilitated and the assemblability of the end cap is thereby improved.

According to an embodiment of the present invention, the end cap inserted portion has a folded structure formed in the folded portion in which the muffler body portion rear end of the muffler rear end portion is folded to the inner side. Accordingly, a portion where the end cap and the muffler are close to each other is smooth and continuous to produce a uniform appearance and the appearance is thereby improved. Moreover, the folded structure of the folded portion can improve the stiffness of the end cap inserted portion and firmly hold the insertion portion of the end cap. Furthermore, since the end cap inserted portion is formed in the folded portion in which the muffler body portion rear end is folded to the inner side, an outer surface of the folded portion can function as an insertion guide inclined surface for the insertion portion of the end cap. Accordingly, when the insertion portion of the end cap is inserted, the insertion is facilitated and the assemblability is thereby improved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not imitative of the present invention, and wherein.

DETAILED DESCRIPTION OF THE PREFERRED EMBODIMENTS

Figure 1:
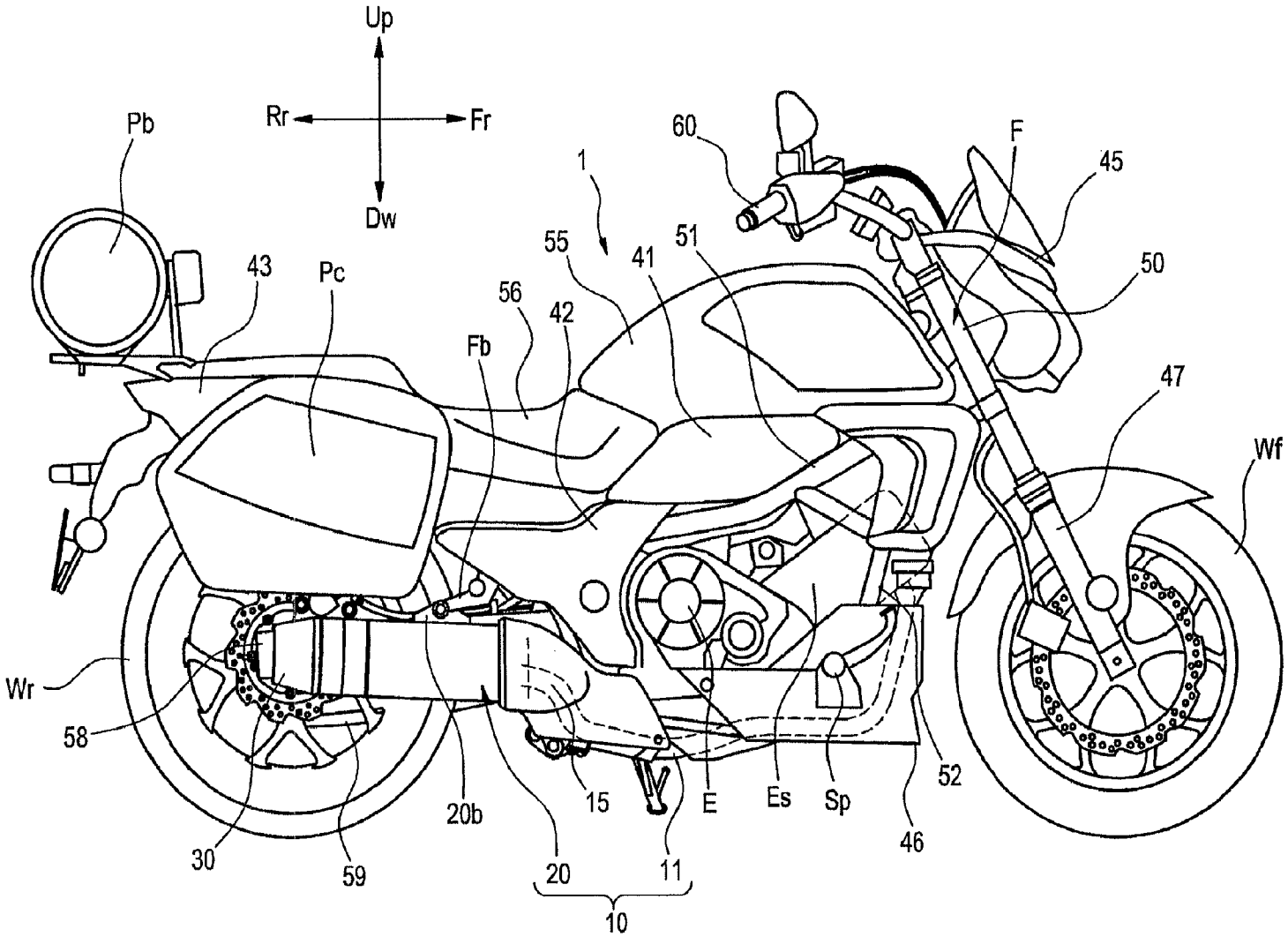
FIG. 1 is a right-side view of a saddle-ride type vehicle including an exhaust system of the present invention.

An embodiment of the present invention is described below.

A motorcycle which is a saddle-ride type vehicle being an embodiment of the present invention is described in detail with reference to FIGS. 1 to 11.

Note that the drawings are to be viewed in a direction in which reference numerals can be read correctly. Moreover, directions with respect to the operating direction of the motorcycle are shown in the drawings, in which Fr denotes a forward direction, Rr denotes a rearward direction, Up denotes an upward direction, Dw denotes a downward direction, L denotes a leftward direction, and R denotes a rightward direction.

Figure 2:
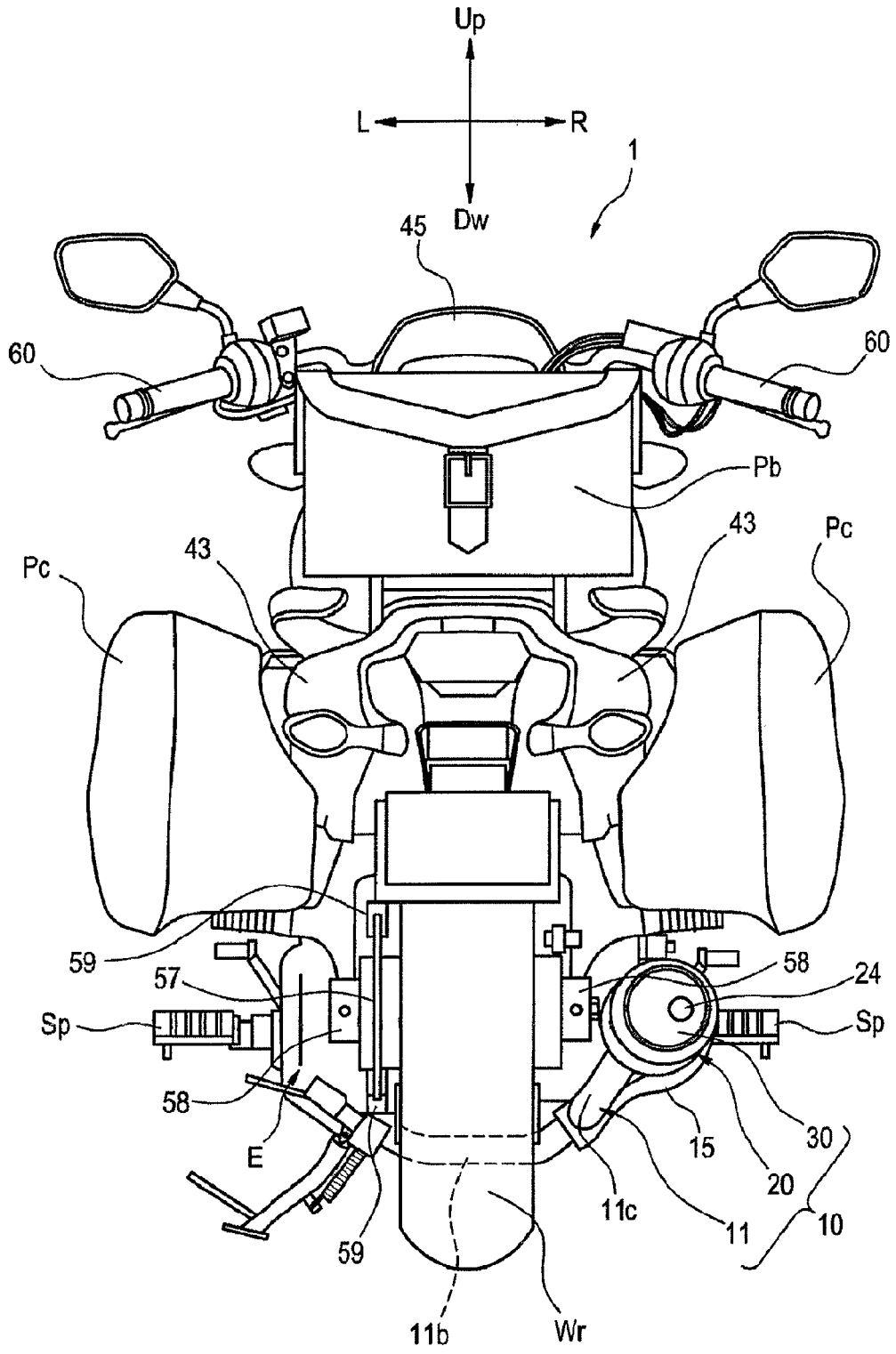
FIG. 2 is a back view of the saddle-ride type vehicle shown in FIG. 1 as viewed from the back.

FIG. 1 shows a side view of a motorcycle 1 of the embodiment as viewed from the right side and FIG. 2 shows a back view of the motorcycle 1 as viewed from the back side.

The motorcycle 1 has a structure in which constituent parts are attached to a vehicle body frame F serving as a framework. More specifically, the vehicle body frame F is provided with a head pipe 50 in a vehicle front end portion and includes a pair of main frames 51, 51 that extend to, for example, left and right from the head pipe 50 and that extend rearward while inclining downward toward the rear. The vehicle body frame F is also provided with down tubes 52, 52 extending toward the bottom and rear of the vehicle body below the main frames 51, 51 and seat rails (not illustrated) extending obliquely upwardly toward the rear of the vehicle from rear end portions of the main frames 51, 51. An engine E is held between the main frames 51, 51 and the down tubes 52, 52.

A front fork 47 supporting a front wheel Wf is steerably supported by the head pipe 50 and a steering handlebar 60 is coupled to an upper portion of the front fork 47. A rear wheel Wr is rotatably held by a swingarm 58 that is swingably attached to the vehicle body frame F behind the engine and which is vertically swingably supported by a rear fork (not illustrated). A drive force of the engine E is transmitted to a sprocket 57 (see FIG. 2) via a chain 59 and the sprocket 57 is thereby driven.

An exterior of the motorcycle 1 in the embodiment is covered with a vehicle body cover as appropriate. More specifically, the exterior of the motorcycle 1 is covered as appropriate with a front cover 45 covering a portion at a vehicle front end side of the head pipe 50, a front side cover 41 covering a lower side of a fuel tank 55, a side cover 42 covering a portion behind the engine, a bottom cover 46 covering a lower side of the engine, and a rear side cover 43 covering a portion below a rider seat 56.

The fuel tank 55 is held above the main frames 51, 51. The rider seat 56 behind the fuel tank 55, pannier cases Pc, Pc disposed on left and right sides of an upper portion of the rear wheel Wr, a back case Pb at a rearmost end of the vehicle, and the like are provided on the seat rails via brackets as needed. As described above, the motorcycle 1 of the embodiment is provided with many storage cases and is a type of vehicle in which foot rests Sp for placing the foots during riding are disposed closer to the front of the vehicle and the rider rides in a relatively relaxed posture and which is thereby suitable for touring and the like.

An exhaust system 10 in the embodiment includes an exhaust pipe 11 extending toward the rear of the vehicle from the engine E and a muffler 20 connected to a rear end of the exhaust pipe 11. As shown in FIGS. 1 and 2, the muffler 20 extends toward the rear of the vehicle, below the pannier case Pc on the right side of the rear wheel Wr, in parallel to the swingarm 58. Moreover, an end cap 30 whose diameter becomes smaller toward the vehicle rear end is mounted at a rearmost end of the muffler 20.

In the exhaust pipe 11 of the exhaust system 10, exhausted pipes connected to exhaust ports of cylinder portions Es in a front portion of the engine E are integrated into one pipe through a manifold and the like (not illustrated) and the one pipe extends toward the rear of the vehicle, on the lower side of the engine E and on the vehicle left side for example. This portion of the exhaust pipe 11 is connected to the muffler 20 via a rightward-curving portion 11*b* (see FIG. 2) curving toward the right side of the vehicle, near a point where the exhaust pipe 11 passes beyond a space under the engine E; and a rising portion 11*c* (see FIGS. 2 and 3) rising while curving upwardly and rearwardly.

Figure 3:
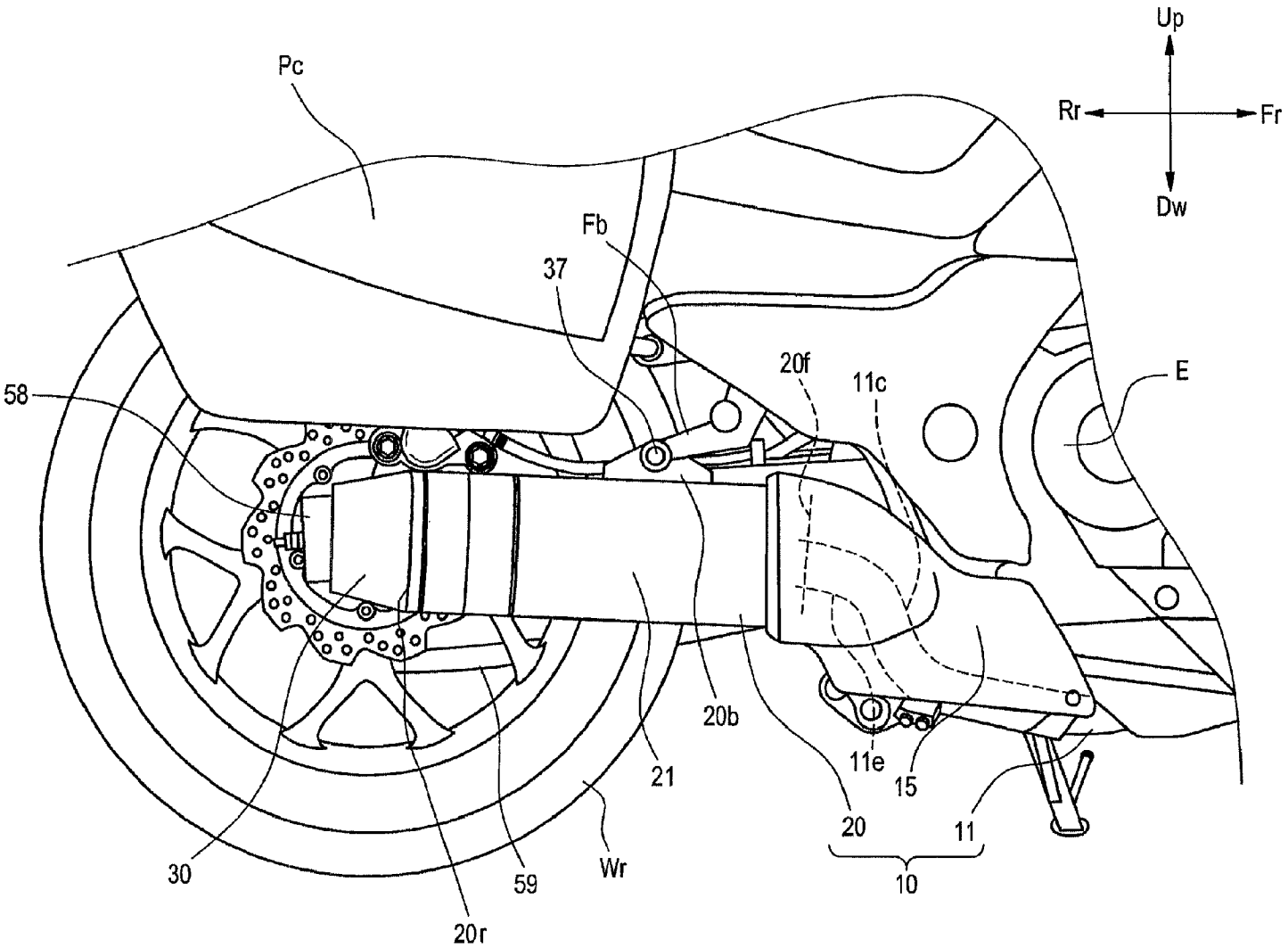
FIG. 3 is an enlarged side view of a main portion of the exhaust system in the saddle-ride type vehicle shown in FIG. 1.

As shown in FIG. 3, an end cap 30 is attached to a muffler rear end portion 20*r* of the muffler 20. Meanwhile, an exhaust pipe rear end portion 11*e* of the exhaust pipe 11 is connected to a muffler front end portion 20*f*. A muffler cover 15 is provided in the muffler front end portion 20*f* to cover the rising portion 11*c* and the exhaust pipe rear end portion 11*e* of the exhaust pipe 11. The muffler 20 is provided with an attachment bracket 20*b* provided at an upper end of a cylindrical muffler body portion 21 and is fixed to an attachment frame Fb of the vehicle body frame F with a fastening bolt 37 and the like in such a way that the muffler body portion 21 is substantially horizontal.

Figure 4:
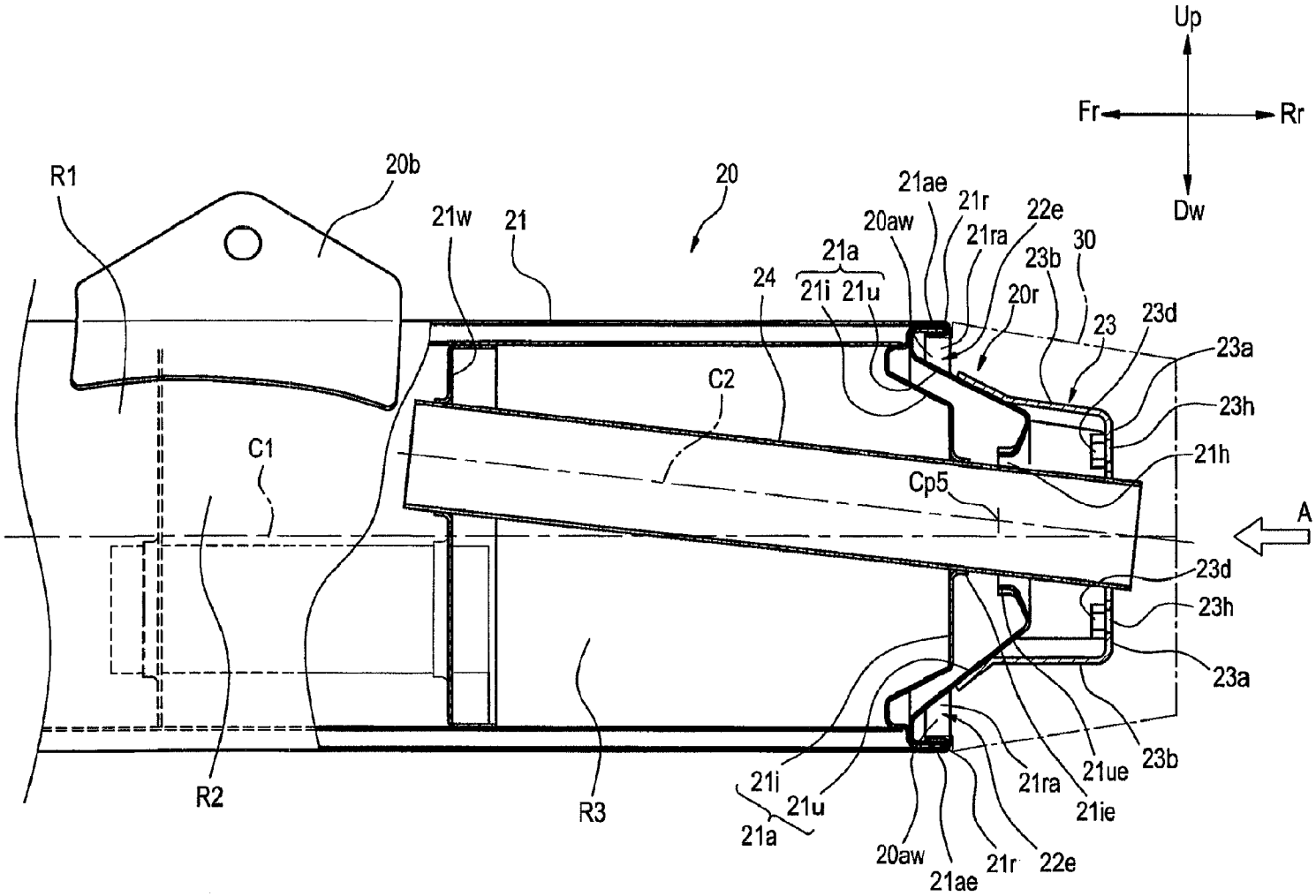
FIG. 4 is a schematic side view of a muffler in the exhaust system of the present invention, the muffler being partially cut away.

In the muffler 20 of the embodiment, for example, as shown in FIG. 4, the interior of the muffler body portion 21 is partitioned into multiple expansion chambers R1, R2, and R3 and a muffler portion and a catalyst are provided as needed. Exhaust gas exhausted from the exhaust pipe 11 into the muffler 20 expands in the expansion chambers R1, R2, and R3 and is then exhausted to the outside atmosphere from a tail pipe 24. A front end portion of the tail pipe 24 is held by a partitioning wall 21*w* while a rear end portion thereof is held by a closing wall 21*a* of the muffler rear end portion 20*r*. Moreover, the tail pipe 24 is provided in such a way that a tail pipe center axis C2 thereof is appropriately inclined with respect to a muffler center axis C1 of the muffler body portion 21.

In the embodiment, the closing wall 21*a* in a rear end portion of the muffler rear end portion 20*r* has, for example, a double-wall structure of an inner wall portion 21*i* and an outer wall portion 21*u*. The tail pipe 24 is fixed to an inner peripheral edge 21*ie* of the inner wall portion 21*i* but does not come into contact with an inner peripheral edge 21*ue* of the outer wall portion 21*u* disposed behind the inner wall portion 21*i* at an interval. More specifically, the tail pipe 24 extends rearwardly with a small gap provided between the tail pipe 24 and a circular tail pipe insertion port 21*h* formed by the inner peripheral edge 21*ue* of the outer wall portion 21*u*. The outer wall portion 21*u* is formed to have a tapered surface whose diameter becomes gradually smaller toward the rear of the vehicle, and an end cap stay 23 for fixing the end cap 30 is attached to the outer wall portion 21*u*.

Figure 5:
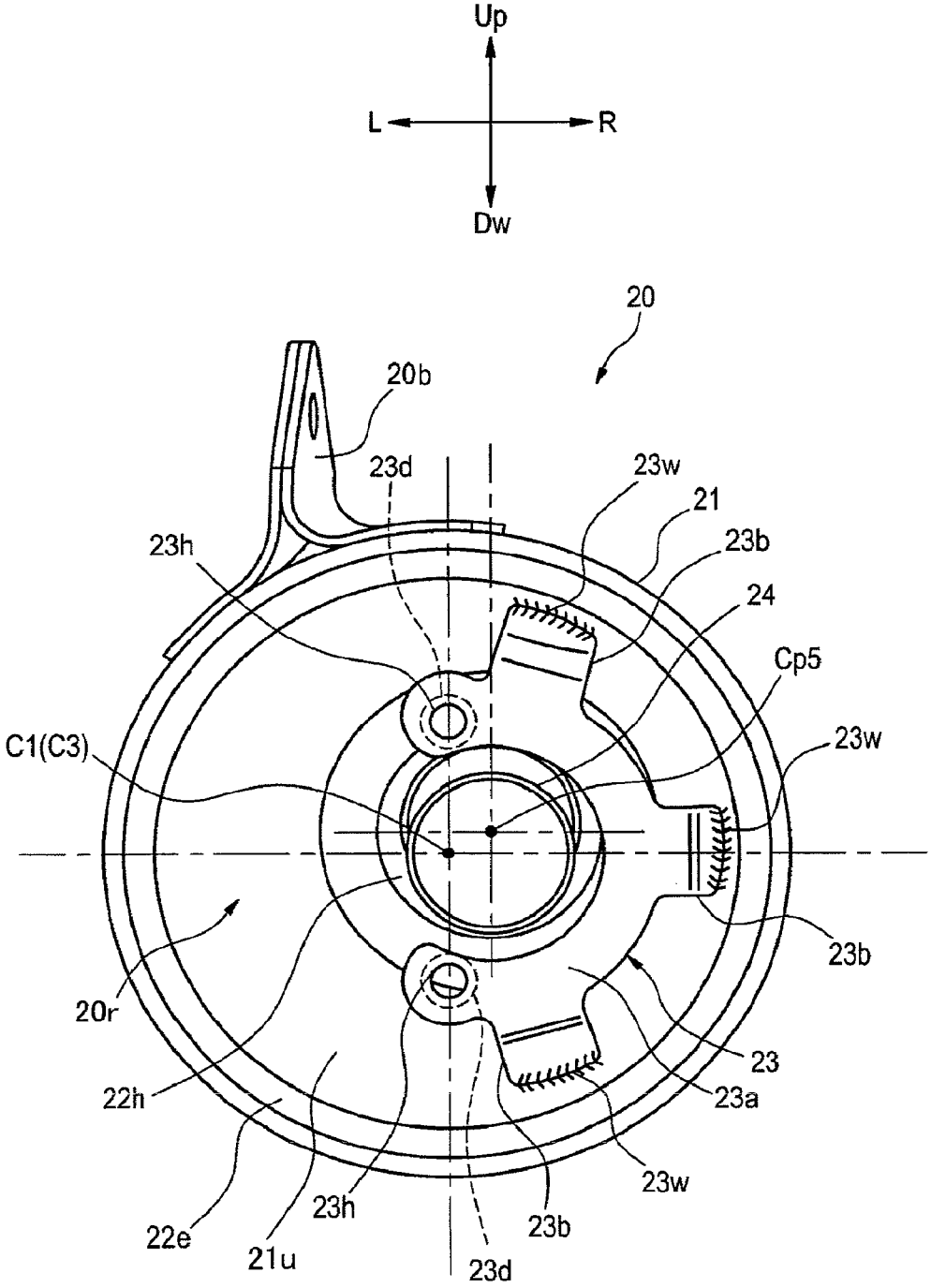
FIG. 5 is a back view of a muffler rear end portion in FIG. 4 before attachment of an end cap, as viewed from the back.

For example, as shown in FIG. 5, the end cap stay 23 includes an inverted-C-shaped cap attachment surface portion 23*a* formed to have a shape of a substantially inverted-C-shaped arc as viewed from the rear of the vehicle and three leg portions 23*b* extending toward the front of the vehicle from the inverted-C-shaped cap attachment surface portion 23*a*. A front end of each of the leg portions 23*b* is fixed in, for example, a welded portion 23*w*. Moreover, the inverted-C-shaped cap attachment surface portion 23*a* is provided with fastening screw insertion holes 23*h*, 23*h* in upper and lower end portions thereof. Boss portions 23*d*, 23*d* including female screws are provided on back sides of the fastening screw insertion holes 23*h*, 23*h* (a left side of the inverted-C-shaped cap attachment surface portion 23*a* in FIG. 4).

The tail pipe insertion port 21*h* is formed about a center point Cp5 offset from the muffler center axis C1, and the end cap stay 23 is also offset from the muffler center axis C1 to the vehicle outer side (right side in FIG. 5). Moreover, the boss portions 23*d*, 23*d* of the end cap stay 23 are disposed on upper and lower sides symmetrically with respect to the muffler center, with the muffler center axis C1 located therebetween.

In the embodiment, as shown in FIG. 4, the inner wall portion 211 and the outer wall portion 21*u* overlap each other in a muffler radial direction in an outer peripheral portion 21*ae* (see the enlarged views of FIGS. 9 and 10) of the closing wall 21*a* of the muffler rear end portion 20*r*. Moreover, the outer peripheral portion 21*ae* in which the wall portions overlap are interposed and held between part of the closing wall 21*a* and a rear edge folded portion 21*ra* in which a muffler body portion rear end 21*r* is folded toward the inner side of the muffler body portion and then toward the front of the vehicle. The rear edge folded portion 21*ra* is formed as an inserted portion inner peripheral wall surface 20*aw* of an end cap inserted portion 22*e*. More specifically, the inserted portion inner peripheral wall surface 20*aw* formed by the rear edge folded portion 21*ra* functions as a wall surface configured to receive the insertion of an insertion portion 32 (see FIGS. 6 and 7) of the end cap 30.

As described above, forming the muffler body portion rear end 21*r* to have a folded structure of the rear edge folded portion 21*ra* as described above improves the stiffness thereof. Accordingly, when the insertion portion 32 of the end cap 30 is inserted to come into contact with the inserted portion inner peripheral wall surface 20*aw* as will be described later, the insertion portion 32 can be firmly held.

The end cap 30 in the embodiment is attached to cover the muffler rear end portion 20*r* as described above. The end cap 30 is described in detail with reference to FIGS. 6 to 11.

Figure 6:
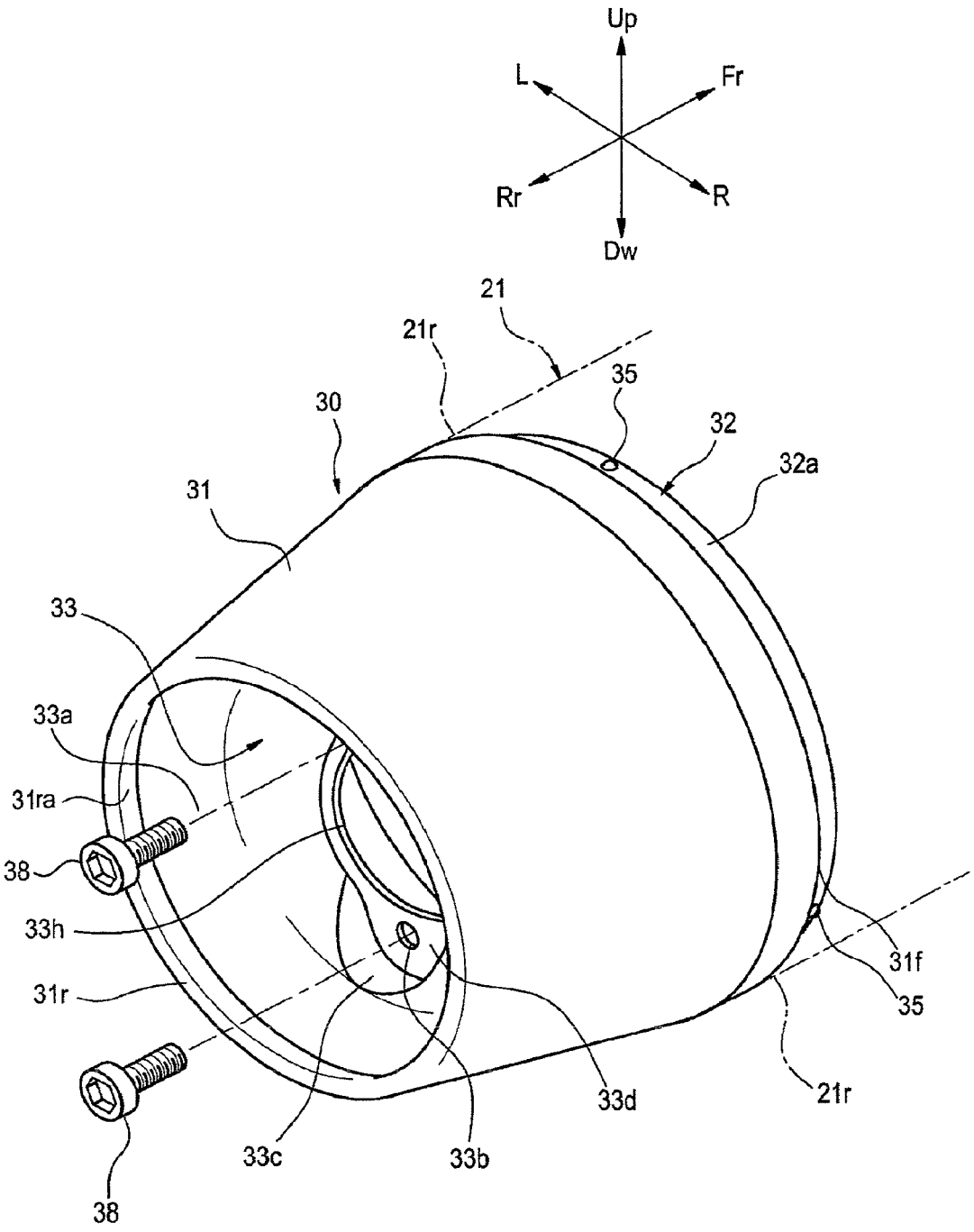
FIG. 6 is an enlarged perspective view of the end cap in the exhaust system of the present invention.
Figure 7:
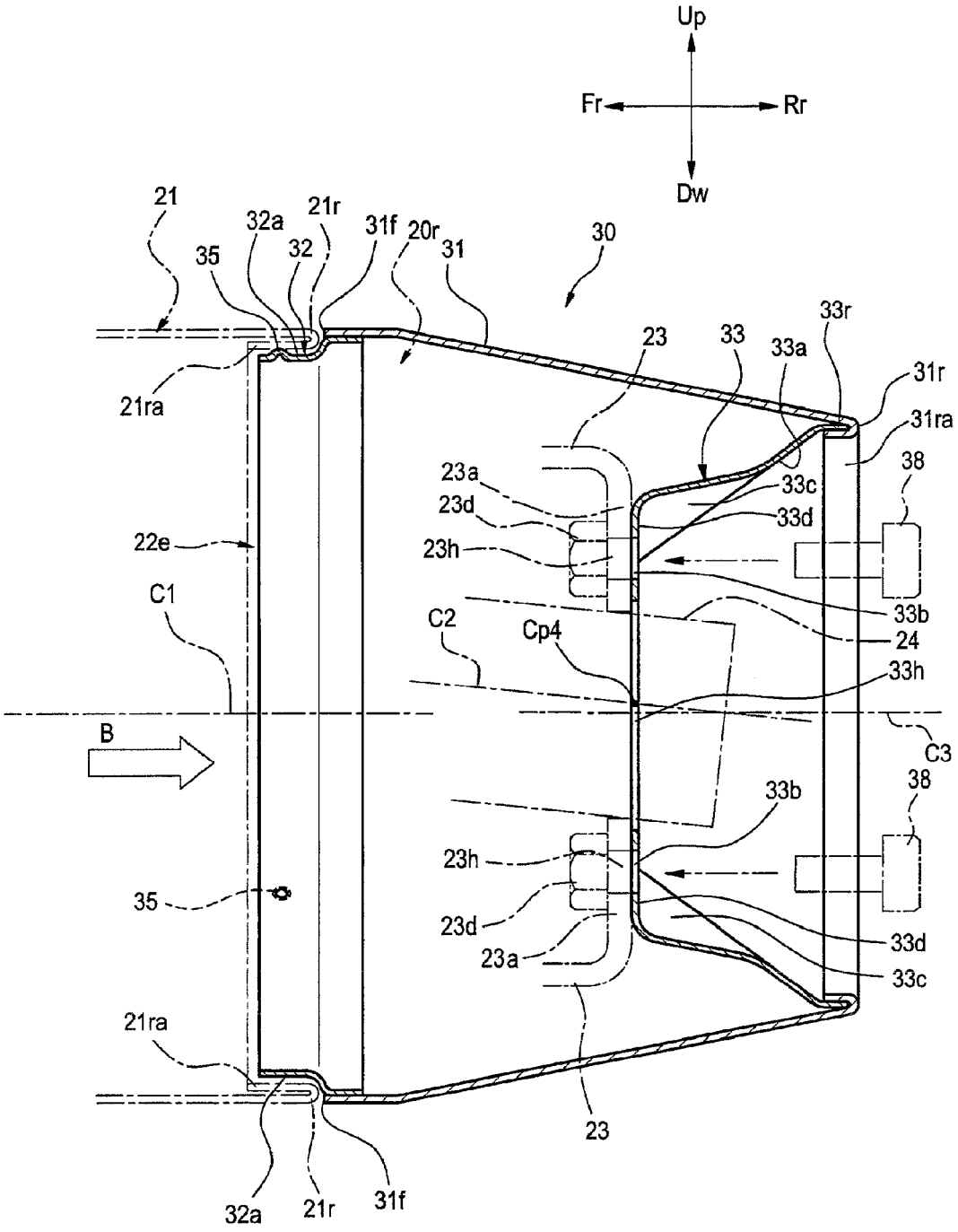
FIG. 7 is an enlarged cross-sectional view of the end cap shown in FIG. 6.

As shown in the perspective view of FIG. 6 and the cross-sectional view of FIG. 7, the end cap 30 of the embodiment includes a cap outer tube portion 31 having a tubular shape whose diameter becomes smaller toward the rear of the vehicle. Moreover, the end cap 30 is provided with a cap inner tube portion 33 attached to a rear end 31*r*, inside the cap outer tube portion 31 and the insertion portion 32 extending forward from a front end 31*f* of the cap outer tube portion 31 and formed to have a diameter slightly smaller than the front end 31*f*.

Figure 8:
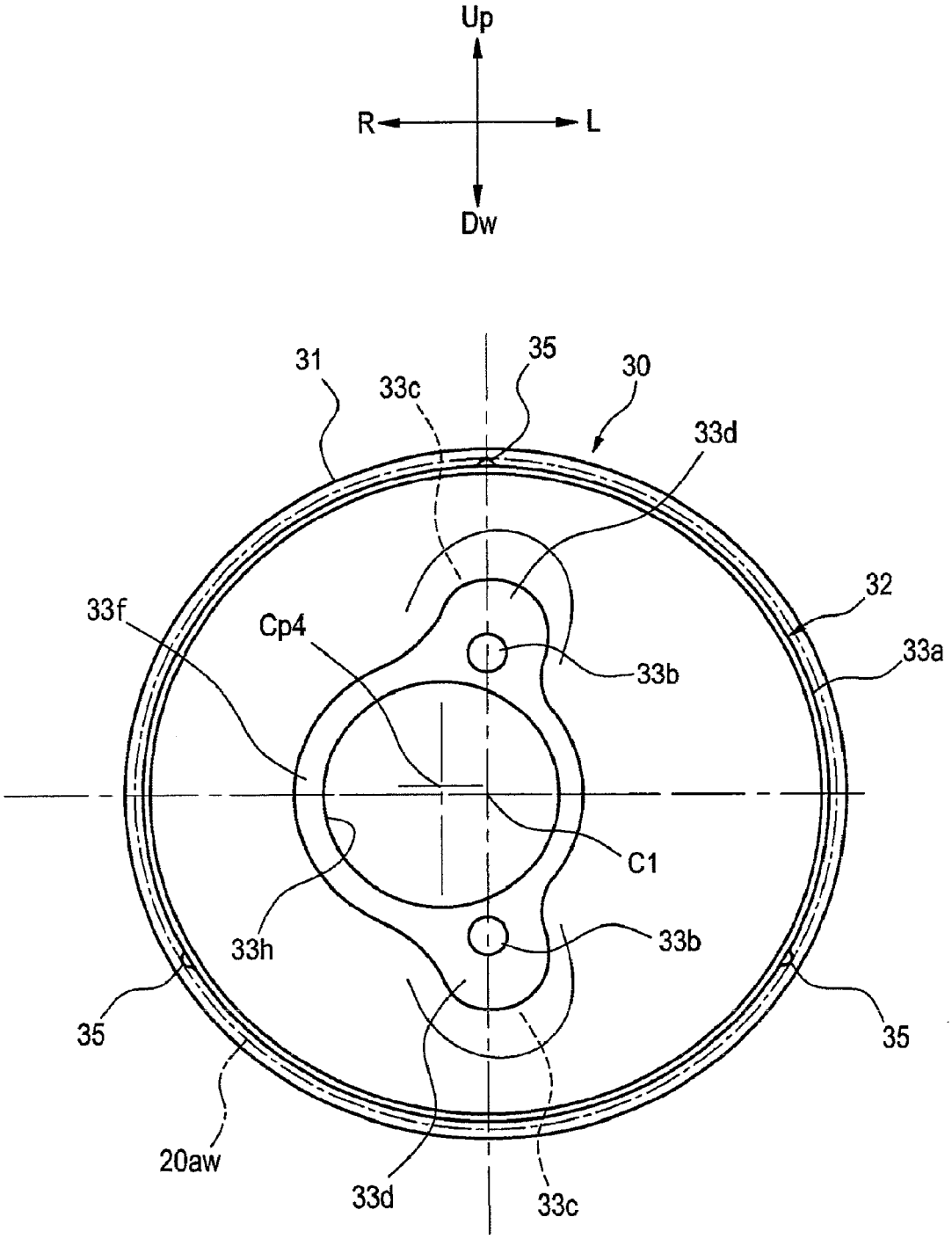
FIG. 8 is a front view of the end cap as viewed in the direction of the arrow B in FIG. 7.

The end cap 30 is attached in such a way that the insertion portion 32 is inserted into the end cap inserted portion 22*e* of the muffler rear end portion 20*r* and the cap inner tube portion 33 is fixed to the end cap stay 23. As shown in FIGS. 7 and 8, multiple protruding portions 35 protruding outwardly in a cap radial direction are formed on an outer surface 32*a* of the insertion portion 32 in the end cap 30 of the embodiment. In the embodiment, three protruding portions 35 are formed arranged in the circumferential direction of the outer surface 32*a* at such positions that intervals therebetween are equal (positions at intervals of 120° as viewed in the direction of the center axis C1 in the embodiment). Moreover, the protruding portions 35 protrude to come in contact with the inserted portion inner peripheral wall surface 20*aw* of the end cap inserted portion 22*e*.

As shown in FIGS. 6 and 7, the cap inner tube portion 33 of the end cap 30 is held in such a way that a rear end outer peripheral edge 33*r* thereof is interposed and held between part of the cap outer tube portion 31 and a folded portion 31*ra* of the rear end 31*r*, and includes a side wall portion 33*a* whose diameter becomes smaller from the rear end outer peripheral edge 33*r* toward the front of the vehicle. Moreover, the cap inner tube portion 33 includes a tail pipe hole 33*h* through which the tail pipe 24 is inserted, at a position slightly offset from a center portion (position on the right side and the upper side as viewed from the rear of the vehicle). Furthermore, a flat corresponding surface portion 33*f* overlappingly corresponding to the inverted-C-shaped cap attachment surface portion 23*a* of the end cap stay 23 is provided in an outer peripheral portion of the tail pipe hole 33*h*, and flat fixed portions 33*d*, 33*d* larger than the corresponding surface portion 33*f* are formed on the upper and lower sides of the corresponding surface portion 33*f*. Paired upper and lower attachment holes 33*b*, 33*b* are formed respectively in the fixed portions 33*d*, 33*d*. The attachment holes 33*b*, 33*b* correspond respectively to the fastening screw insertion holes 23*h*, 23*h* of the inverted-C-shaped cap attachment surface portion 23*a* and have such structures that fastening members 38, 38 are allowed to be screwed into the boss portions 23*d*, 23*d*.

The boss portions 23*d* of the embodiment are disposed at two positions symmetric about the muffler center axis C1. Disposing the boss portions 23*d* for fixing the end cap 30 at two position symmetric about the muffler center axis C1 (the center axis C3 of the end cap is coaxial thereto) makes it less likely for the fastening positions to shift and the contact force of the end cap 30 can act evenly in the muffler radial direction that is provided by the protruding portions 35. Moreover, since the alignment of the end cap 30 is facilitated by the contact force of the protruding portions 35, fixation can be surely performed with such a small number of fastening positions as two.

In the embodiment, portions where the attachment holes 33*b*, 33*b* are formed are at positions relatively deep inside the end cap 30. However, tool insertion recessed portions 33*c* in which portions around the fixed portions 33*d*, 33*d* are recessed are formed in the side wall portion 33*a* to facilitate the insertion of a tool for fastening the fastening members 38, 38. This structure facilitates the fastening of the fastening members 38, 38.

In the embodiment, the center axis C3 of the end cap 30 is arranged coaxially with the center axis C1 of the muffler 20. Meanwhile, the center axis C2 of the tail pipe 24 is offset from the center axis C1 of the muffler 20 to the right side and slightly to the upper side as viewed from the rear of the vehicle. More specifically, the tail pipe 24 is disposed in such a way that the center axis C2 thereof passes through the center point Cp4 of the tail pipe hole 33*h*.

Offsetting the center axis C2 of the tail pipe 24 from the muffler center axis C1 as described above allows the direction of the exhaust and the length of the tail pipe to be arbitrarily set. As a result, degrees of freedom in muffler performance adjustment is improved. Moreover, in terms of appearance, the structure is such that the center axis C3 of the end cap 30 and the center axis C1 of the muffler 20 are aligned with each other (see FIG. 7). As a result, the end cap 30 appears to be integrally connected to the muffler body portion 21.

Attachment and assembly of the end cap 30 are described below with reference to FIGS. 9, 10 and 11.

First, the insertion portion 32 of the end cap 30 is inserted into the end cap inserted portion 22*e* (direction of the arrow A). At this time, the front end of the insertion portion 32 enters the inner side of the inserted portion inner peripheral wall surface 20*aw*, and then, the three protruding portions 35 come into contact with a curved surface of an insertion guide inclined surface 21*rt* (a state shown by a one-dot chain line in FIG. 9). This is because the protruding height of each protruding portion 35 is set such that the protruding portion 35 is located on an outer side of the inner diameter of the inserted portion inner peripheral wall surface 20*aw*. By further pressing the end cap 30 inward, the protruding portions 35 are guided to the inner side of the inserted portion inner peripheral wall surface 20*aw* by the curved surface of the insertion guide inclined surface 21*rt* (a state shown in FIG. 9). In other words, when the end cap 30 is inserted into the end cap inserted portion 22*e* (in the direction of the arrow A in FIG. 9), a slight pressing force is required for the insertion.

Figure 9:
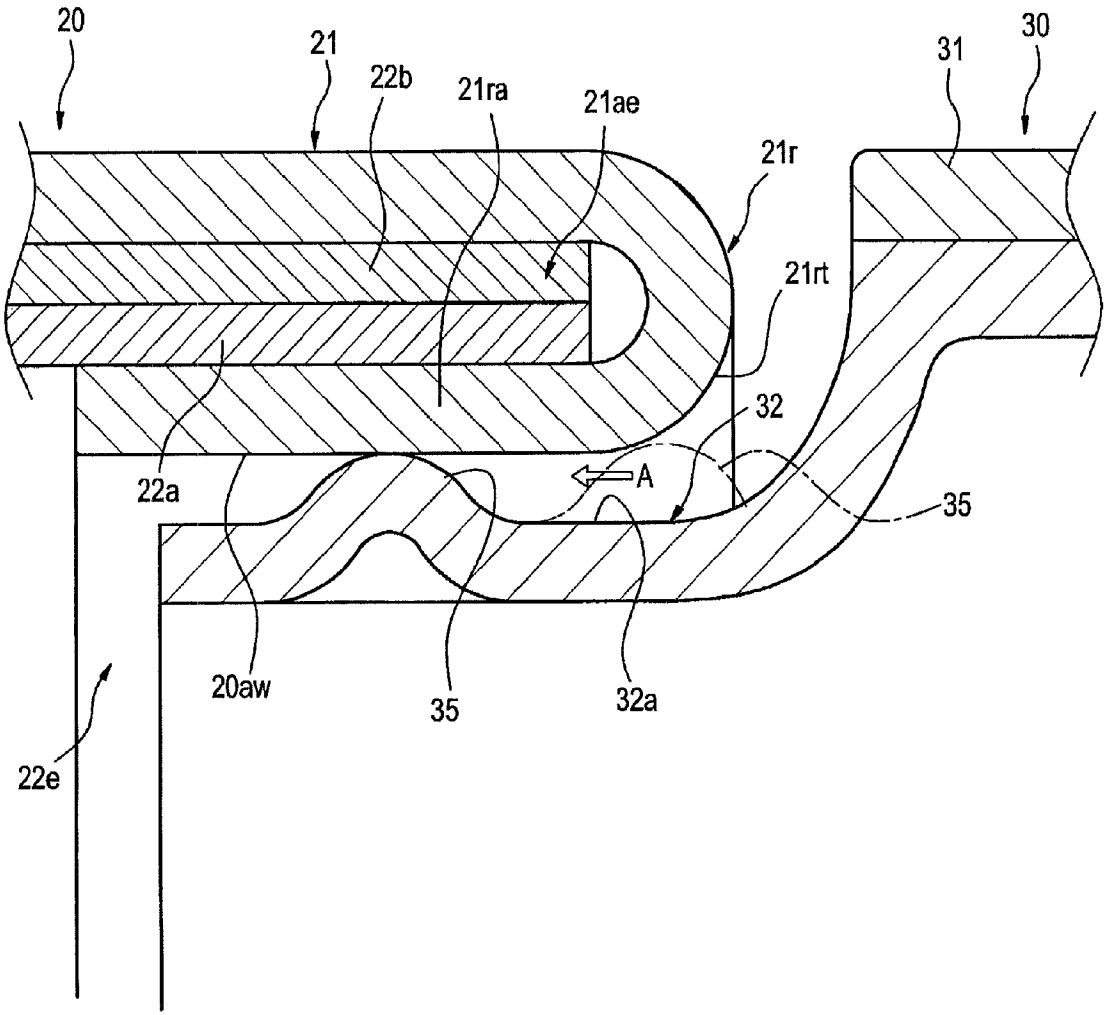
FIG. 9 is an enlarged cross-sectional view showing an engagement state between an end cap inserted portion of the muffler rear end portion and protruding portions of an insertion portion of the end cap.
Figure 10:
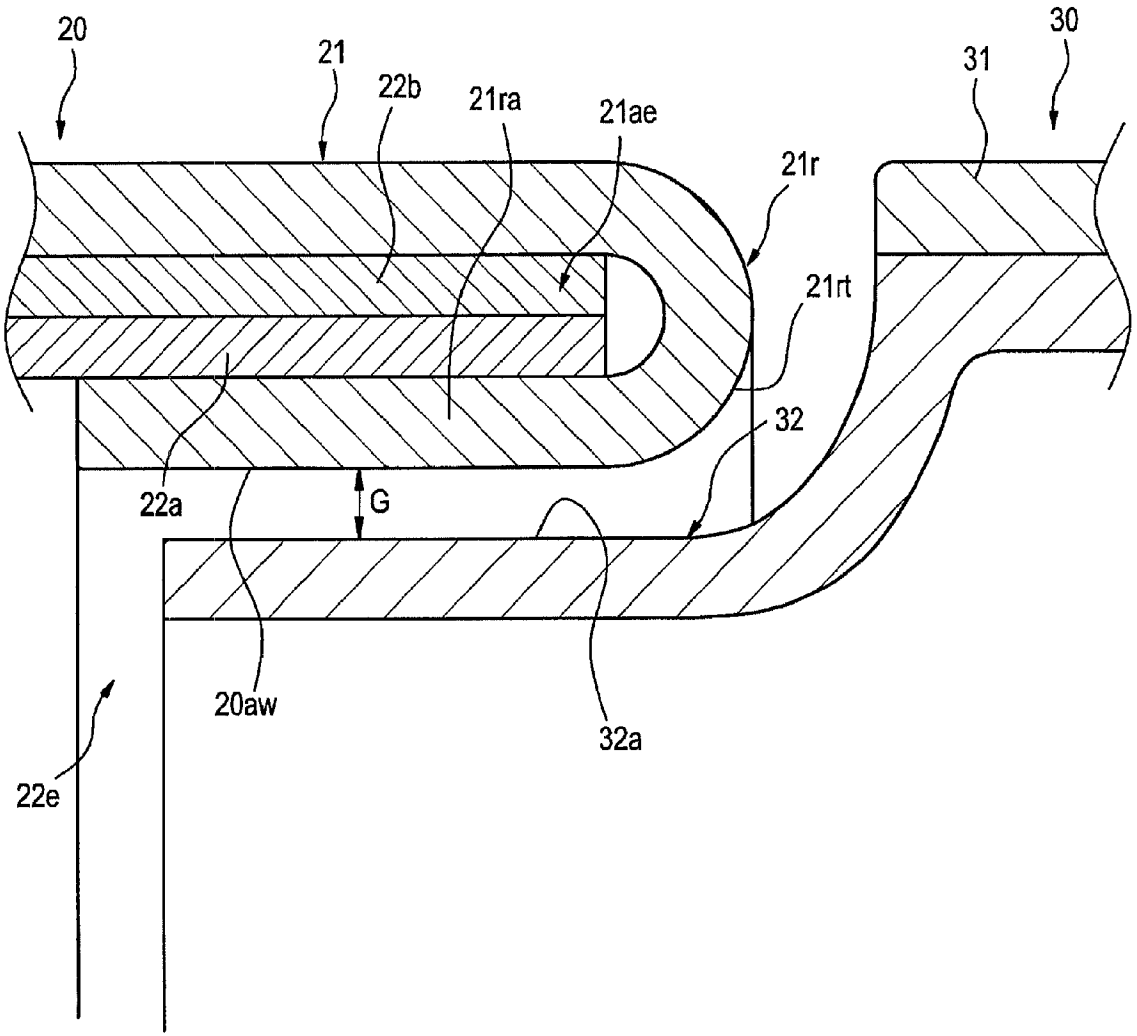
FIG. 10 is an enlarged cross-sectional view showing an engagement state between the end cap inserted portion of the muffler rear end portion and portions other than the protruding portions of the insertion portion of the end cap.

The insertion operation of the insertion portion 32 of the end cap 30 causes the end cap 30 to be set to a state where the three protruding portions 35 are brought in contact with the inserted portion inner peripheral wall surface 20*aw* as shown in FIG. 9. Meanwhile, in portions other than the protruding portions 35, as shown in FIG. 10, a gap G is formed between the inserted portion inner peripheral wall surface 20*aw* and the outer surface 32*a*. In a state where the three protruding portions 35 are in contact with the inserted portion inner peripheral wall surface 20*aw*, there is achieved alignment in which the center axis C3 of the end cap 30 is aligned with the center axis C1 of the muffler 20. In the state where the alignment is achieved, the attachment holes 33*b*, 33*b* can be easily aligned with the fastening screw insertion holes 23*h*, 23*h* by turning the end cap 30. Thereafter, the fastening members 38, 38 are screwed into the boss portions 23*d*, 23*d*.

Since the insertion portion 32 of the end cap 30 is held by the muffler body portion rear end 21*r* having a multiple structure surrounding the outer peripheral portion 21*ae* of the closing wall 21*a*, the insertion portion 32 is held firmly with extremely high stiffness. Moreover, the insertion portion 32 is more firmly fixed with the fastening members 38, 38 and the boss portions 23*d*, 23*d*.

Figure 11:
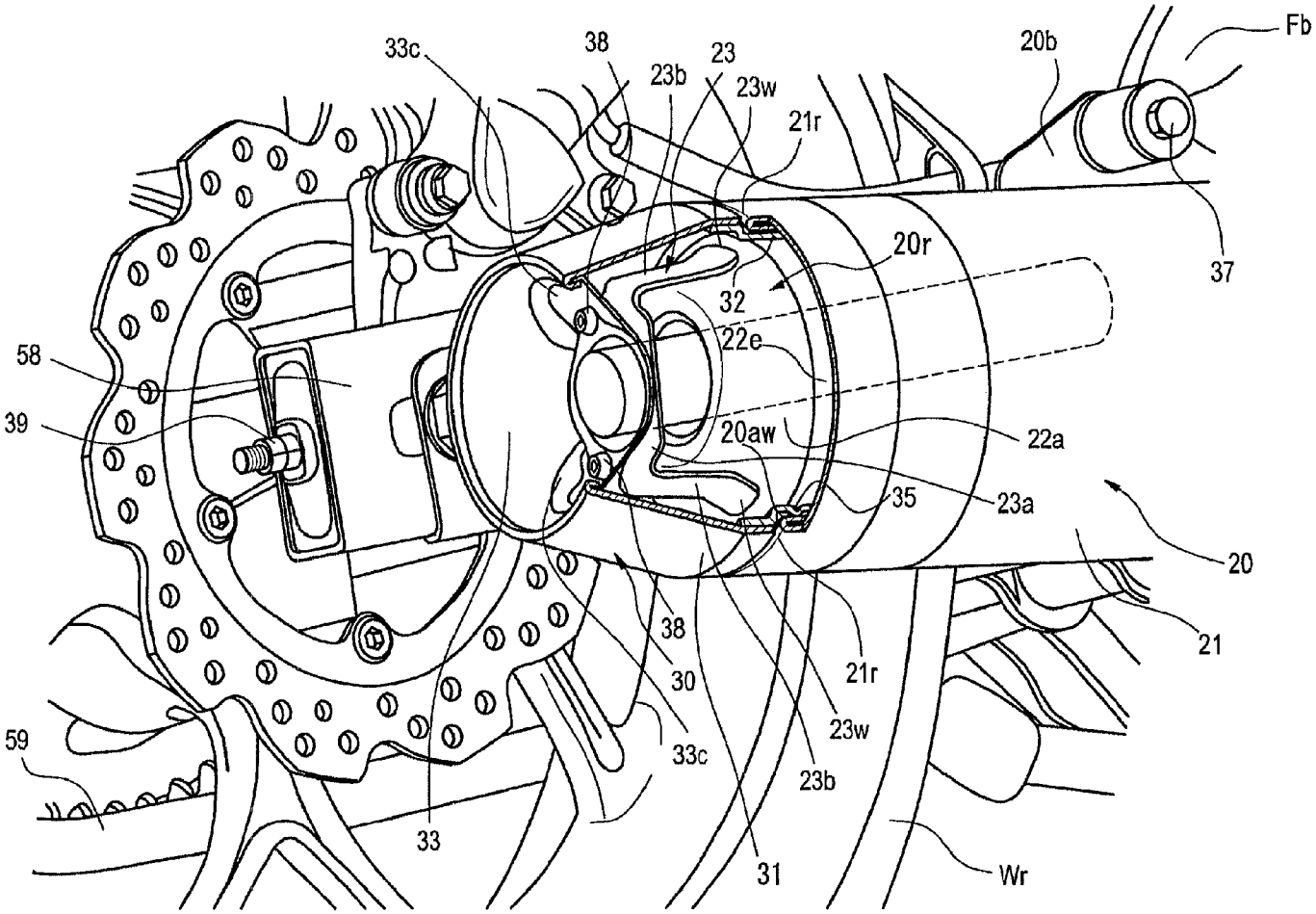
FIG. 11 is a perspective view of a muffler rear portion of the exhaust system shown in FIG. 3 as viewed from the back, the muffler rear portion partially cut away.

FIG. 11 shows a perspective view of a state where the end cap 30 is assembled as described above.

As shown in FIG. 11, the end cap 30 is fixed to the end cap stay 23 with the fastening members 38 with the insertion portion 32 inserted into and held by the end cap inserted portion 22*e* of the muffler rear end portion 20*r*. Since the protruding portions 35 of the insertion portion 32 of the end cap 30 are in contact with the inserted portion inner peripheral wall surface 20*aw* of the muffler rear end portion 20*r*, no unexpected contact between the end cap 30 and the muffler body portion 21 due to muffler vibration (a state where the end cap 30 and the muffler body portion 21 come into contact and move away) occurs as described above. Thus, the occurrence of a knocking sound can be more effectively suppressed.

The embodiment to which the present invention is applied has been described above. However, the present invention is not limited to this embodiment. For example, in the structure of the embodiment described above, the number of the protruding portions 35 is three but may be any number more than three.

Furthermore, in the embodiment described above, the description is given of the motorcycle. However, the present invention is not limited to this and can be applied to other saddle-ride type vehicles such as three-wheel vehicles and four-wheel vehicles.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims

What is claimed is:

1. An exhaust system of a saddle-ride vehicle that includes a tubular muffler connected to an exhaust pipe for discharging exhaust of an engine and including an end cap attached to a muffler rear end portion of the muffler, comprising:

an insertion portion at an front end side of the end cap, said insertion portion being inserted into and held by an end cap inserted portion provided in the muffler rear end portion;

a plurality of protruding portions protruding outward in a radial direction, said plurality of protruding portions being formed on an outer surface of the insertion portion, at a predetermined interval in a circumferential direction of the outer surface; and the protruding portions come in contact with an inserted portion inner peripheral wall surface of the end cap inserted portion;

wherein the end cap inserted portion is formed in a folded portion in which a muffler body portion rear end of the muffler rear end portion is folded to an inner side.

2. The exhaust system of a saddle-ride vehicle according to claim 1, wherein the protruding portions are provided at three positions at substantially equal intervals in the circumferential direction.

3. The exhaust system of a saddle-ride vehicle according to claim 1, wherein the end cap is attached to a boss portion provided in the muffler rear end portion with a fastening member.

4. The exhaust system of a saddle-ride vehicle according to claim 2, wherein the end cap is attached to a boss portion provided in the muffler rear end portion with a fastening member.

5. The exhaust system of a saddle-ride type vehicle according to claim 3, wherein the boss portion is provided at two positions symmetric to each other about a muffler center axis.

6. The exhaust system of a saddle-ride vehicle according to claim 1, wherein:

a center axis (C3) of the end cap and a center axis (C1) of the muffler are arranged coaxial to each other;

a center axis (C2) of a tail pipe for discharging the exhaust from the muffler is offset from the center axis (C1) of the muffler; and a tail pipe hole of the end cap through which the tail pipe is inserted is offset from the center axis (C3) of the end cap and the center axis (C2) of the tail pipe is arranged to pass through a center point (Cp4) of the tail pipe hole.

7. The exhaust system of a saddle-ride vehicle according to claim 5, wherein:

a center axis (C3) of the end cap and a center axis (C1) of the muffler are arranged coaxial to each other;

a center axis (C2) of a tail pipe for discharging the exhaust from the muffler is offset from the center axis (C1) of the muffler; and a tail pipe hole of the end cap through which the tail pipe is inserted is offset from the center axis (C3) of the end cap and the center axis (C2) of the tail pipe is arranged to pass through a center point (Cp4) of the tail pipe hole.

8. The exhaust system of a saddle-ride vehicle according to claim 1, wherein:

the end cap includes a tubular cap outer tube portion, an insertion portion extending forward from a front end of the cap outer tube portion and a cap inner tube portion attached to an inner side of a rear end of the cap outer tube portion and disposed closer to a front of the vehicle than the rear end;

a fixed portion configured to be fastened to the boss portion is provided in the cap inner tube portion; and a tool insertion recessed portion allowing insertion of a tool is formed around the fixed portion.

9. The exhaust system of a saddle-ride vehicle according to claim 6, wherein:

the end cap includes a tubular cap outer tube portion, an insertion portion extending forward from a front end of the cap outer tube portion and a cap inner tube portion attached to an inner side of a rear end of the cap outer tube portion and disposed closer to a front of the vehicle than the rear end;

a fixed portion configured to be fastened to the boss portion is provided in the cap inner tube portion; and a tool insertion recessed portion allowing insertion of a tool is formed around the fixed portion.

10. The exhaust system of a saddle-ride vehicle according to claim 8, wherein the end cap inserted portion is formed in a folded portion in which a muffler body portion rear end of the muffler rear end portion is folded to an inner side.

11. An exhaust system of a saddle-ride vehicle comprising:

a tubular muffler connected to an exhaust pipe for discharging exhaust of an engine;

an end cap attached to a muffler rear end portion, said end cap having a front end side;

an insertion portion at the front end side of the end cap, said insertion portion being inserted into and held by an end cap inserted portion;

a plurality of protruding portions protruding outwardly in a radial direction, said plurality of protruding portions being formed on an outer surface of the insertion portion, at a predetermined interval in a circumferential direction of the outer surface; and the plurality of protruding portions are held in contact with an inserted portion inner peripheral wall surface;

wherein the end cap inserted portion is formed in a folded portion in which a muffler body portion rear end of the muffler rear end portion is folded to an inner side.

12. The exhaust system of a saddle-ride vehicle according to claim 11, wherein the protruding portions are provided at three positions at substantially equal intervals in the circumferential direction.

13. The exhaust system of a saddle-ride vehicle according to claim 11, wherein the end cap is attached to a boss portion provided in the muffler rear end portion with a fastening member.

14. The exhaust system of a saddle-ride vehicle according to claim 12, wherein the end cap is attached to a boss portion provided in the muffler rear end portion with a fastening member.

15. The exhaust system of a saddle-ride type vehicle according to claim 13, wherein the boss portion is provided at two positions symmetric to each other about a muffler center axis.

16. The exhaust system of a saddle-ride vehicle according to claim 11, wherein:

a center axis (C3) of the end cap and a center axis (C1) of the muffler are arranged coaxial to each other;

a center axis (C2) of a tail pipe for discharging the exhaust from the muffler is offset from the center axis (C1) of the muffler; and a tail pipe hole of the end cap through which the tail pipe is inserted is offset from the center axis (C3) of the end cap and the center axis (C2) of the tail pipe is arranged to pass through a center point (Cp4) of the tail pipe hole.

17. The exhaust system of a saddle-ride vehicle according to claim 11, wherein:

the end cap includes a tubular cap outer tube portion, an insertion portion extending forward from a front end of the cap outer tube portion and a cap inner tube portion attached to an inner side of a rear end of the cap outer tube portion and disposed closer to a front of the vehicle than the rear end;

a fixed portion configured to be fastened to the boss portion is provided in the cap inner tube portion; and a tool insertion recessed portion allowing insertion of a tool is formed around the fixed portion.

18. The exhaust system of a saddle-ride vehicle according to claim 16, wherein:

the end cap includes a tubular cap outer tube portion, an insertion portion extending forward from a front end of the cap outer tube portion and a cap inner tube portion attached to an inner side of a rear end of the cap outer tube portion and disposed closer to a front of the vehicle than the rear end;

a fixed portion configured to be fastened to the boss portion is provided in the cap inner tube portion; and a tool insertion recessed portion allowing insertion of a tool is formed around the fixed portion.

19. An exhaust system of a saddle-ride vehicle that includes a tubular muffler connected to an exhaust pipe for discharging exhaust of an engine and including an end cap attached to a muffler rear end portion of the muffler, comprising:

an insertion portion at an front end side of the end cap, said insertion portion being inserted into and held by an end cap inserted portion provided in the muffler rear end portion;

a plurality of protruding portions protruding outward in a radial direction, said plurality of protruding portions being formed on an outer surface of the insertion portion, at a predetermined interval in a circumferential direction of the outer surface;

the protruding portions come in contact with an inserted portion inner peripheral wall surface of the end cap inserted portion;

a center axis (C3) of the end cap and a center axis (C1) of the muffler are arranged coaxial to each other;

a center axis (C2) of a tail pipe for discharging the exhaust from the muffler is offset from the center axis (C1) of the muffler; and a tail pipe hole of the end cap through which the tail pipe is inserted is offset from the center axis (C3) of the end cap and the center axis (C2) of the tail pipe is arranged to pass through a center point (Cp4) of the tail pipe hole.

20. An exhaust system of a saddle-ride vehicle that includes a tubular muffler connected to an exhaust pipe for discharging exhaust of an engine and including an end cap attached to a muffler rear end portion of the muffler, comprising:

an insertion portion at an front end side of the end cap, said insertion portion being inserted into and held by an end cap inserted portion provided in the muffler rear end portion;

a plurality of protruding portions protruding outward in a radial direction, said plurality of protruding portions being formed on an outer surface of the insertion portion, at a predetermined interval in a circumferential direction of the outer surface;

the protruding portions come in contact with an inserted portion inner peripheral wall surface of the end cap inserted portion;

the end cap includes a tubular cap outer tube portion, an insertion portion extending forward from a front end of the cap outer tube portion and a cap inner tube portion attached to an inner side of a rear end of the cap outer tube portion and disposed closer to a front of the vehicle than the rear end;

a fixed portion configured to be fastened to the boss portion is provided in the cap inner tube portion; and a tool insertion recessed portion allowing insertion of a tool is formed around the fixed portion.

21. An exhaust system of a saddle-ride vehicle comprising:

a tubular muffler connected to an exhaust pipe for discharging exhaust of an engine;

an end cap attached to a muffler rear end portion, said end cap having a front end side;

an insertion portion at the front end side of the end cap, said insertion portion being inserted into and held by an end cap inserted portion;

a plurality of protruding portions protruding outwardly in a radial direction, said plurality of protruding portions being formed on an outer surface of the insertion portion, at a predetermined interval in a circumferential direction of the outer surface;

the plurality of protruding portions are held in contact with an inserted portion inner peripheral wall surface;

a center axis (C3) of the end cap and a center axis (C1) of the muffler are arranged coaxial to each other;

a center axis (C2) of a tail pipe for discharging the exhaust from the muffler is offset from the center axis (C1) of the muffler; and a tail pipe hole of the end cap through which the tail pipe is inserted is offset from the center axis (C3) of the end cap and the center axis (C2) of the tail pipe is arranged to pass through a center point (Cp4) of the tail pipe hole.

22. An exhaust system of a saddle-ride vehicle comprising:

a tubular muffler connected to an exhaust pipe for discharging exhaust of an engine;

an end cap attached to a muffler rear end portion, said end cap having a front end side;

an insertion portion at the front end side of the end cap, said insertion portion being inserted into and held by an end cap inserted portion;

a plurality of protruding portions protruding outwardly in a radial direction, said plurality of protruding portions being formed on an outer surface of the insertion portion, at a predetermined interval in a circumferential direction of the outer surface;

the plurality of protruding portions are held in contact with an inserted portion inner peripheral wall surface;

the end cap includes a tubular cap outer tube portion, an insertion portion extending forward from a front end of the cap outer tube portion and a cap inner tube portion attached to an inner side of a rear end of the cap outer tube portion and disposed closer to a front of the vehicle than the rear end;

a fixed portion configured to be fastened to the boss portion is provided in the cap inner tube portion; and a tool insertion recessed portion allowing insertion of a tool is formed around the fixed portion.

* * * * *